United States Patent [19]

Deloughery

[11] Patent Number: 4,815,301

[45] Date of Patent: Mar. 28, 1989

[54] PORTABLE ICE SKATING RINK

[76] Inventor: Edith Deloughery, 3 Brookfield Dr., Northford, Conn. 06472

[21] Appl. No.: 245,699

[22] Filed: Sep. 19, 1988

[51] Int. Cl.[4] ..... A63C 19/10

[52] U.S. Cl. ..... 62/235; 62/56

[58] Field of Search ..... 62/235, 56

[56] References Cited

U.S. PATENT DOCUMENTS

| | | | |
|---|---|---|---|
| 2,996,896 | 8/1961 | Johnson | 62/235 |
| 3,012,596 | 12/1961 | Skolout . | |
| 3,379,031 | 4/1968 | Lewis, Jr. | 62/235 |
| 3,721,418 | 3/1973 | Vincent | 62/235 |
| 3,808,831 | 5/1974 | Landry | 62/235 |
| 3,933,002 | 1/1976 | Vickery | 62/56 |

*Primary Examiner*—Lloyd L. King

*Attorney, Agent, or Firm*—F. R. Hirtler

[57] ABSTRACT

A portable ice skating rink comprising a liner having end portions capable of being raised to an essentially rectangular position in relation to the liner and at least the end portions being inflatable, and rink blocks having a main body containing a cavity capable of receiving the end portions of the liner through a slotted opening, and when inflated the end portions pressing against the sides of the cavity thus forming a watertight seal, and means for interconnecting the rink blocks.

7 Claims, 2 Drawing Sheets

PORTABLE ICE SKATING RINK

This invention deals with an ice skating rink which is portable, readily assembled or disassembled and which provides desirable accommodations for the user.

BACKGROUND OF THE INVENTION

Ice skating is a winter sport widely exercised throughout the world be it by using indoor facilities or by skating on frozen rivers, ponds and lakes. Because of the inherent danger connected with natural bodies of water it is highly desirable to have an artificial skating rink available for the family or the community which may be readily erected, provides a water depth sufficient for a smooth ice surface, and which may be easily disassembled with essentially no damage to the environment.

Certain references of interest have been found which deal with ice skating rinks, however, none provides the advantages of the instant invention. More specifically, these comments are in order:

U.S. Pat. No. 2,996,896 (Johnson) describes a portable skating rink consisting of a framework made from wooden beams bolted together and surrounding plastic sheeting the edges of which are upturned against such framework and held in place by additional beams bolted against the framework thus forming a pan capable of holding water.

U.S. Pat. No. 3,012,596 (Skolout) teaches an ice skating rink including plastic sheeting which is placed over a surrounding wall and held in place with clips.

U.S. Pat. No. 3,721,418 (Vincent) discloses a mold for forming a layer of ice comprising essentially a flat bag which can be filled with water and once the water is frozen, the top layer of the bag is removed exposing the ice surface.

U.S. Pat. No. 3,797,049 (De Santo) is concerned with a skating rink surrounded by side elements or barriers against the inner wall of which is placed a plastic liner and fastened thereto by clips of various sizes and shapes.

U.S. Pat. No. 3,808,831 Landry) deals with a skating rink which is a one-piece design, namely, a sheet carrying at its outer ends water-impervious tubing which, when filled with water and frozen forms the outer walls of the rink.

U.S. Pat. No. 3,933,002 (Vickery) discloses an ice skating rink whose walls are formed by tubing containing water or foam, and a sheet draped over such tubing and held in place by clips.

U.S. Pat. No. 4,135,634 (Frye) teaches the use of rigid corrugated PVC or ABS tubing for forming the walls for an ice skating rink over which sheeting is placed and held to the tubing by clipping means.

None of the above references is believed to disclose, anticipate or make obvious the instant invention.

SUMMARY OF THE INVENTION

It is the object of this invention to provide an ice skating rink that is readily assembled and disassembled.

It is another object of this invention to provide a portable ice skating effectively sealing off the water contained therein.

It is a further object of this invention to provide a portable ice skating rink which may readily be drained.

It is still another object of this invention to provide an ice skating rink wherein the surrounding restraining rink blocks provide seating accommodations.

It is still a further object of this invention to provide a portable ice skating rink wherein the rink blocks are easily interconnected and locked.

Other objects of this invention will become apparent by the ensuing description and claims.

DESCRIPTION OF THE PREFERRED EMBODIMENTS

Figure 1:
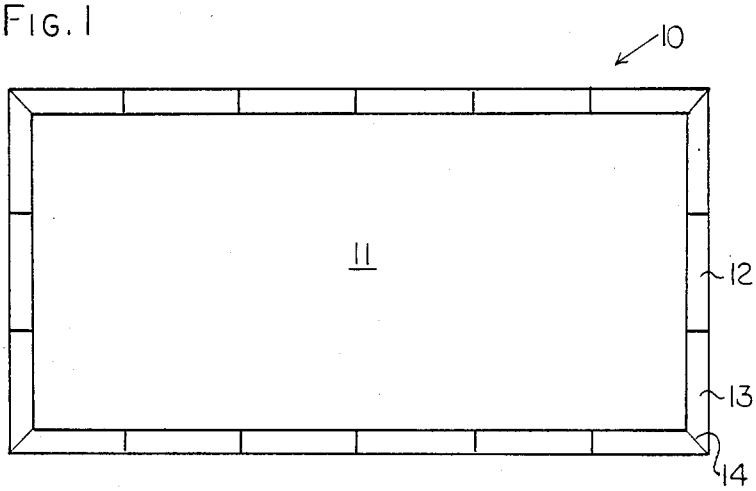
FIG. 1 is a plan view of an ice skating rink of this invention.

As indicated in FIG. 1 the ice skating rink 10 of this invention comprises liner 11 and surrounding rink blocks 12 and 13, wherein blocks are designed as straight sections whereas blocks 13 are designed to accommodate the corners by having diagonally cut end sides 14. It should be mentioned that the ice skating rink of this invention may have any suitable shape e.g. circular, oval, hour glass type, triangular, hexagonal, etc. and it being understood that liner and blocks will have to have a configuration to fit into such diverse shape without being outside the disclosure and claims of this invention.

Figure 2:
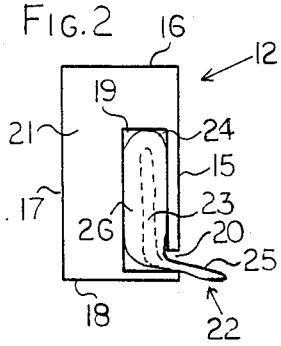
FIGS. 2–4 are elevated crossectional side views of rink blocks of this invention.

FIG. 2 represents a rink block designed to provide an outline of the ice skating rink as well as seal, support and protection of the rink liner 22, wherein block 12 comprises body 21, top side 16, back side 17, bottom side 18 and front side 15 leaving cavity 19 occupied by end portion 26 of liner 22, the end portion being illustrated in its collapsed state 23 (interrupted lines) and expanded state 24 and narrowing to the preferably non-extendable or inflatable bottom section 25 which reaches out of cavity 19 through block opening 20.

Figure 3:
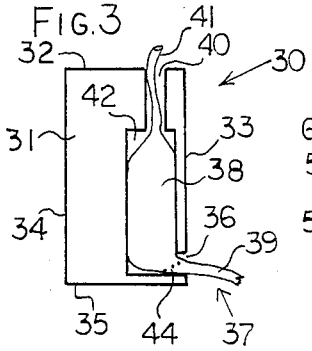

FIG. 3 describes rink block 30 having a body 31, a top side 32, a front side 33, a back side 34 and bottom 35, cavity 42 being essentially occupied by extended i.e. inflated end 38 of liner 37, the latter being equipped with an inflation inlet 41 reaching through body 31 and beyond top side 32. The inflation inlet 41 may serve for blowing air in the inflatable and expandable end of the liner thereby providing a water tight seal by pressing against the walls of the cavity; or it may serve as a means for deflating the liner ends allowing ready release of the liner from the block cavity through the exit slots as shall be further described below. The inflation inlet may be any suitable means generally known for such applications such as a movable ball valve, valves used for pneumatic tires, clamp type closure or the like. As also indicated in FIG. 3, liner 37 extends through opening 36 between front side 33 and bottom 35 of rink block 30, and the non-inflatable portion 39 is closed off to inflatable end 38 by separator 44, however, such separator may not be necessary if the main section of the liner is constructed as a single ply type sheet or as a fused two-ply assembly. For improved insulation, the main section of the liner. i.e. the section that will be in contact with the ground or other supporting surface, may also be inflatable, however, such total inflatability makes the liner more prone to be damaged losing its seal maintained by air pressure.

Figure 4:
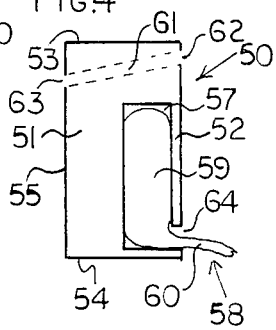

FIG. 4 illustrates another embodiment of a rink block 50 of this invention comprising a body 51 having top side 53, back side 55, bottom 54 and front side 52 enclosing cavity 57 taken up essentially by inflated end 59 of liner 58 whose non-inflated portion 60 extends through opening 64. Block 50 is also equipped with spillway 61 extending through the width of the body 51 from the front opening 62 to back opening 63, said passage being slightly slanted towards the back of the block for easy run off of excess water which may have been caused by overfilling the rink, thus it is avoided to have water flow over the top of the block possibly making it slippery and when frozen creating a hazard for the user.

Figure 5:
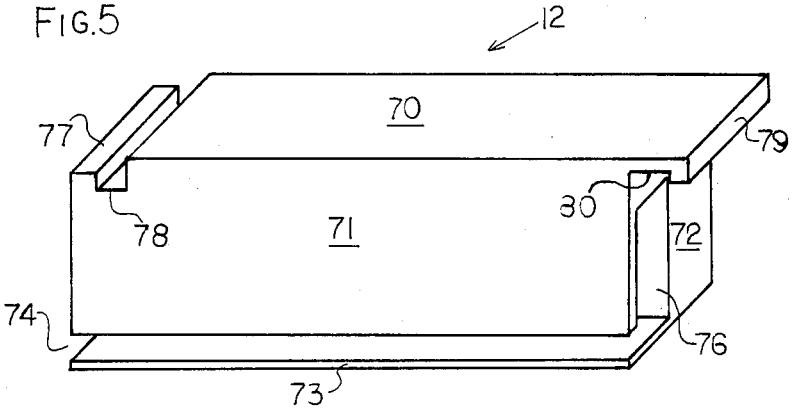
FIG. 5 is an elevated perspective front view of a rink block of this invention.

In FIG. 5 a rink block 12 is illustrated having top side 70, front side 71, right side 72 and bottom portion 73 leaving cavity 76 and slot opening 74, also shown are tongues 77, 79 and grooves 78 and 80 allowing interlocking of such blocks.

Figure 6:
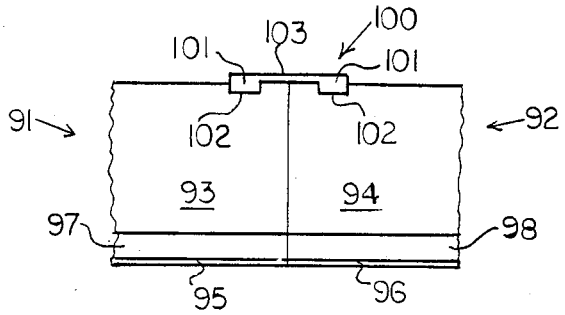
FIG. 6 is an elevated front view of two partial rink blocks of this invention.

FIG. 6 describes an alternate means for connecting rink blocks 91 and 92, both only partially shown, by a separate and removable block lock 100 having insert sections 101 interconnected by bridge 103 and wherein insert sections are placed into block grooves 102 of each block; the latter having front side 93 and 94, bottom portions 95 and 96 and slotted openings 97 and 98, respectively.

Figure 7:
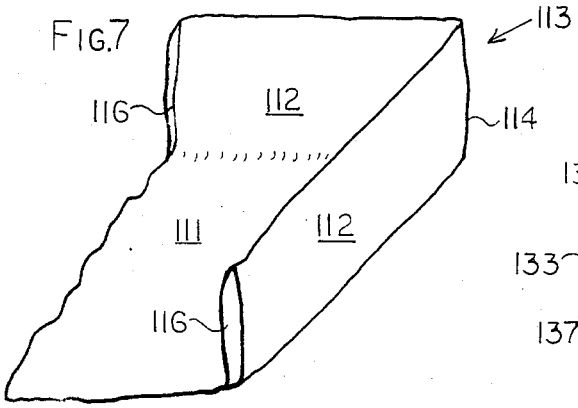
FIGS. 7 and 8 are elevated perspective front views of partial rink liners according to this invention.

In FIG. 7 is depicted a rink liner 110 having a main section 111 and ends 112 raised essentially rectangularly in relation to the main section 111 and forming a continuous side around corner 114. It is also indicated at points 116 that ends 112 are hollow for the purpose of inflatability.

Figure 8:
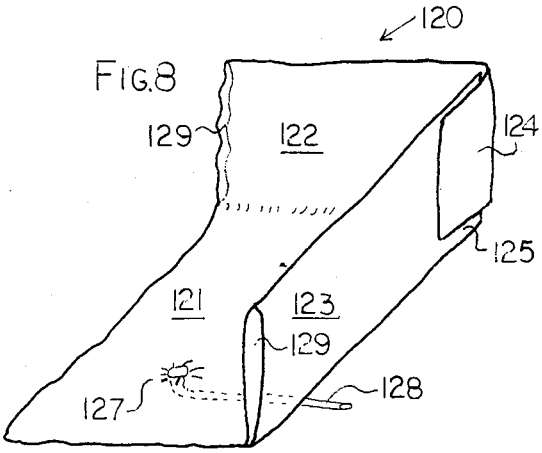

FIG. 8 demonstrates another embodiment of a rink liner 120 of this invention wherein the main section 121 is bordered by ends 122 and 123 not directly connected with each other, end 122 capable of overlapping end 125 with flap 124 thereby providing a watertight connection . Main section 121 is equipped with drain hole 127 and drain hose 128; liner ends 122 and 123 are kept hollow, as shown at points 129, so that may be inflated for sealing purposes. Also, hose 128 may carry a shut-off valve, clamp or other means to stop the flow of water or to drain the rink if desired. The inside of flap 124 and the outside of liner end 123 may be equipped with hook-and-loop type fastening means such as known as Velcro [trademark].

Figure 9:
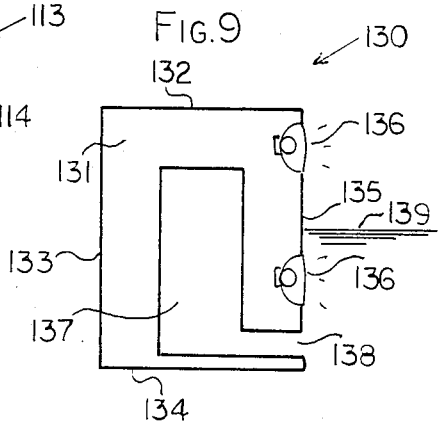
FIG. 9 is a crossectional side view of another embodiment of a rink block according to this invention.

FIG. 9 illustrates rink block 130 having a body 131, a top side 132, back side 133, bottom portion 134, cavity 137, front cover 135 and slotted opening 138, wherein front cover 135 carries two electrical illumination means 136, one situated above and one situated below water/ice surface 139.

Figure 10:
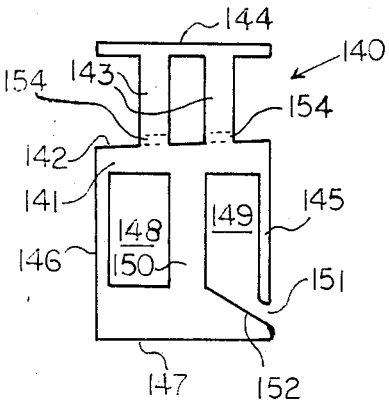
FIG. 10 is a crossectional side view of still another rink block of this invention.

In FIG. 10 a further modification of a rink block 140 of this invention having body 141, top side 142, back side 146, bottom portion 147, front portion 145, liner end insert cavity 149 and slotted opening 151, support 150 and internal cavity 148 as well as seat 144 having seat supports 143; this type rink block not only has provision for sitting but also includes a spillway 154 preventing the wetting and icing up of the seat 144 in case rink is being overfilled with water. It should be noted that the exit portion 152 of the cavity is slanted towards the outside to allow quick drainage of water when emptying the rink. Cavity 148 has been included mainly for the reduction of weight and material cost.

When setting up the ice skating rink of this invention it is advisable to seek a substantially levelled ground or surface, spread out the rink liner with the edge portions thereof raised while still deflated (if the ends are provided with overlapping means as illustrated in FIG. 8 item 124, such means have to be engaged at that point). Slide non-inflated edge portions into cavities of rink blocks through slotted openings and interconnect blocks with connecting means provided. Inflate rink liner or at least the liner ends using suitable means such as a bicycle pump. Once the pressure in the ends is considered high enough to provide a watertight seal, the inflation close outlet and fill water in the rink area to a level of about 2 to 4 inches, and let freeze. It will be noted that there are certain advantages of this invention over prior art constructions, namely, although expansion of at least the surface of the water is expected due to freezing, such expansion is readily absorbed by the combination of flexible front portions and the cushioning effect of the inflated ends of the liner. Furthermore, invariably skaters especially less experienced ones will move against the surrounding restrains causing damage to and possibly leakage of the liners of the prior art, whereas in the instant invention the liner ends are well protected by the front portions of the rink blocks. The illuminating means indicated in FIG. 9 may be battery powered or may be attached to normal (110 V) lines by properly insulated lines well known to the art. The lights—there may be only one light or a plurality thereof—may be located above, below the ice line or both illuminating at least the boundaries of the rink enhancing thereby the safety of skaters.

As materials of construction for the rink blocks are suggested wood, metal (preferably covered by plastic coating) such as aluminum or steel, or perferably plastic such as polyethylene, polypropylene, poly(acrylonitrile-butadiene-styrene) known as ABS, polyester, polyamide or mixtures of such plastic, with or without glass reinforcement, or combination of such materials. The rink liner including inflatable ends should be flexible and may be made from elastomers such as polybutadiene, polyisoprene, natural rubber, poly(butadiene-styrene), poly(butadiene-acrylonitrile), polyurethane, poly(ethylene-propylene) or poly(ethylene-propylene-non-conjugated diene) and the like, or fabric coated with such elastomers or with the above mentioned plastics. The materials used preferably have a glass transition temperature below the anticipated use temperatures of the rink in order to avoid damage due to embrittlement.

Certain modfications may be provided with the ice skating rink of this invention such as rink blocks equipped with a railing, or rink liner including therein cooling means such as flexible tubing embedded in such liner and connected to a freezing unit. Suffice to say that, depending on the size rink blocks used, the rink may be suitable as a swimming or wading pool.

Other modifications and variations of this invention may be envisioned, but although not specifically disclosed they are believed to fall well within the scope of the appended claims.

What is claimed is:

1. A portable ice skating rink comprising a liner having end portions capable of being raised to an essentially rectangular position in relation to the liner and at least the end portions being inflatable, and rink blocks having a main body containing a cavity capable of receiving the end portions of the liner through a slotted opening, and when inflated the end portions pressing against the sides of the cavity thus forming a watertight seal, and means for interconnecting the rink blocks.

2. The skating rink of claim 1 wherein the interconnecting means are tongue-and-groove type, overlapping hook-and-groove type, or separate insert sections connected by a bridge section.

3. The skating rink of claim 1 wherein the liner includes drainage means and the rink block includes a spillway.

4. The skating rink of claim 1 wherein the whole liner in inflatable.

5. The skating rink of claim 1 wherein the rink block includes illumination means.

6. The skating rink of claim 3 wherein the rink block is equipped with means for sitting.

7. A method for forming an ice skating ring comprising providing a portable ice skating rink of claim 1, spreading the rink liner, raising the edge portions thereof, sliding non-inflated edge portions into cavities of rink blocks through slotted openings, interconnect rink blocks, inflate edge portions of liner until a watertight seal is formed within the rink block cavities, and fill skating rink with water to an appropriate level and let freeze.

* * * * *